United States Patent [19]

Suzuki

[11] Patent Number: 4,524,961

[45] Date of Patent: Jun. 25, 1985

[54] PAPER DISCHARGE APPARATUS FOR USE IN PAPER FOLDERS OF ROTARY PRESSES

[75] Inventor: Yosihide Suzuki, Toride, Japan

[73] Assignee: Komori Printing Machinery Co., Ltd., Tokyo, Japan

[21] Appl. No.: 490,661

[22] Filed: May 2, 1983

Related U.S. Application Data

[63] Continuation of Ser. No. 246,739, Mar. 23, 1981, abandoned.

[30] Foreign Application Priority Data

Apr. 2, 1980 [JP] Japan ..... 55-44926[U]

[51] Int. Cl.[3] ..... B41F 13/58

[52] U.S. Cl. ..... 270/4; 198/366; 271/9

[58] Field of Search ..... 270/4, 52–60; 271/301, 304, 9; 198/366, 369, 371; 493/424–433

[56] References Cited

U.S. PATENT DOCUMENTS

| | | | |
|---|---|---|---|
| 1,245,728 | 11/1917 | Jennings | 198/369 |
| 3,748,039 | 7/1973 | Kuhn | 271/9 |
| 3,784,187 | 1/1974 | Takayanagi | 270/6 X |

*Primary Examiner*—A. J. Heinz

*Attorney, Agent, or Firm*—Charles E. Pfund

[57] ABSTRACT

In a paper discharged apparatus for use in a paper folder of the type forming sections of different type, sections of the different type are conveyed in the same direction to the same place by first and second conveyors. The first conveyor has an upper horizontal run and a lower inclined run and has a triangular cross-sectional configuration. The second conveyor has an upper inclined run extending in the direction of the lower run of the first conveyor. A change gear mechanism provided to reverse the direction of running of the first conveyor.

5 Claims, 4 Drawing Figures

PAPER DISCHARGE APPARATUS FOR USE IN PAPER FOLDERS OF ROTARY PRESSES

This is a continuation of application Ser. No. 246,739 filed Mar. 23, 1981, now abandoned.

BACKGROUND OF THE INVENTION

This invention relates to a paper discharge apparatus utilized to convey sections folded by a folding device of a rotary press to a stacker.

In a web rotary press in which printing is made on a web of paper supplied from a paper roll, there is provided a folding device which cuts the printed web into a predetermined length and then fold the cut length, and a stacker which accumulates the sections is associated with the folding device. The sections sequentially discharged from the stack by means of an impeller located at one end of the folding machine is conveyed to a stacker with a conveyor.

In recent years a folding device has been developed capable of forming a plurality of types of sections with the same folding device. In such a folding device since the directions of discharging the folded paper are different depending upon the type of the section there arise a number of problems including an arrangement of the conveyors for conveying discharged section. More particularly, each time the type of the section changes, it is necessary to shift in the vertical direction the conveyors on the side of the folding device or on the side of the stacker, or to move the entire stacker to a paper discharge position. Where a stacker is not located in a direction of paper discharge so that the movement of the stacker is impossible, it is necessary for the operator to manually accumulate the sections or it is necessary install an additional stacker. This greatly impairs operating efficiency or increases the cost of installation and the floor area occupied.

SUMMARY OF THE INVENTION

Accordingly, it is an object of this invention to provide a paper discharge apparatus for use in a paper folder of a rotary press in which different types of sections are formed by the folder and such sections of different type are conveyed in the same direction to the same place, thus improving the efficiency of discharging and stacking the sections.

According to this invention, there is provided a paper discharge apparatus for use in a paper folder of a rotary press comprising a first conveyor having an upper horizontal run and a downwardly inclined run, height thereof increasing toward a direction of transfer, the first conveyor having a triangular sectional configuration and operating to transfer section, along the upper horizontal run, a second conveyor having an upper run extending along the inclined run for transferring other type of sections supplied to a lower end of the second conveyor to the same place as the first conveyor, and a gear mechanism for reversing the direction of running of the first conveyor, the gear mechanism being constructed so as to transfer the sections by either one of the first and second conveyors by switching the gear mechanism.

DESCRIPTION OF THE PREFERRED EMBODIMENT

Figure 1:
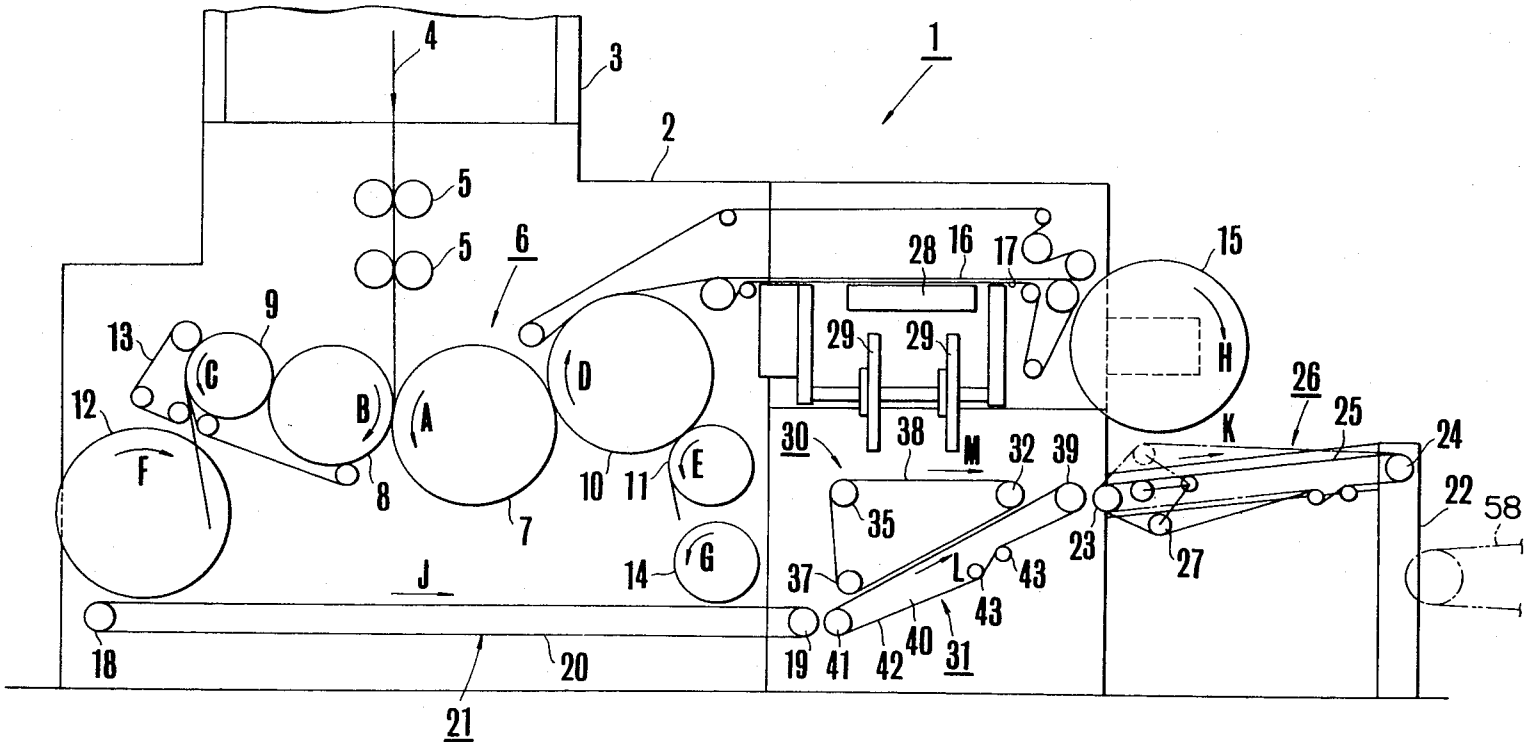
FIG. 1 is a diagrammatic side view showing a folding device embodying the invention.

A folding device 1 shown in the accompanying drawings comprises a frame 2 and a paper feed frame 3 integrally mounted on the frame 2. A paper web 4 printed with a printed unit (not shown) located to the left as viewed in FIG. 1 is guided to the folding unit 6 via a paper feeder located above the paper feed frame 3 and a plurality of sets of nipping rollers 5. The folding unit 6 comprises a folding roller 7 rotated in a direction of arrow A and having an effective diameter twice as that of the platen roller of the printing unit, and in front of the folding roller 7 is disposed an overlapping roller 8 rotated in the direction of arrow B in contact with the folding roller 7 and having an effective diameter of 1.5 times of the platen roller, that is $\frac{3}{4}$ of that of the folding roller 7. A needle roller 9 having the effective diameter as the overlapping roller is disposed to the left and in contact therewith. The needle roller 9 is rotated in a direction shown by arrow C.

A gripping roller 10 having the same diameter as the folding roller 7 and rotated in a direction of arrow D is disposed to the right of the folding roller 7 in contact therewith. A paper discharge roller 11 having the same effective diameter as the platen and rotated in a direction of arrow E is located on the lower right side of the gripping roller 10 in contact therewith.

Each of these rollers 7 through 11 is provided with a cutter or a gripping device at the periphery at a position at which adjacent rollers contact with each other, so that the printed web is cut to a predetermined length and then folded with the central portion gripped by the gripping device. Thus, as the web 4 sequentially passes about the folding roller 7, ovelapping roller 8 and the needle roller 9, a section cut and wrapped about the overlapping roller 8 is fed at a rate of two per one revolution to the needle roller 9 and then discharged with two sections overlapped. When the web 4 is passed through the folding roller 7 and the gripping roller 10, the section cut and wrapped about the folding roller 7 is folded by being delivered to the gripping roller 10 with its central portion gripped by the gripping roller 10 and the folded section is discharged onto the gripping roller 10. When the printed web 4 is passed through the folding roller 7, gripping roller 10 and discharged roller 11, the section cut and wrapped about the folding roller 7 is delivered to and folded by the gripping roller 10 with the central portion gripped by the gripping roller 10. The central portion of the section is gripped by the discharge roller 11 to be folded into four folds and then discharged to the lower side of the discharge roller 11.

Each of the three types of the folded paper paths of the folding unit 6 is provided with an impeller and a discharge conveyor at the discharge end of the path. More particularly, an impeller 12 rotated in the direction of arrow F and provided with a plurality of arcuate vanes extending in the radial direction is disposed beneath the needle roller 9 for discharging towards lower sections fed to the impeller by being clamped between an endless belt 13 and the periphery of the gripping roller 9. An impeller 14 rotated in the direction of arrow G and having the same construction as the impeller 12 is disposed beneath the discharge roller 11 for discharging toward the lower sections fed from the discharge roller 11. A similar impeller 15 rotated in the direction of H is disposed at the righthand end of the frame 2 for discharging toward lower the sections discharged from the gripping roller 10 and conveyed by upper and lower belts 16 and 17. A discharged paper conveyor 21 constituted by end rollers 18 and 19, and a plurality of endless belts 20 passing about the rollers 18 and 19 is disposed beneath the paper folder 6 and close to the floor surface for conveying sections discharged from impellers 12 and 14 in the direction of arrow J. Between the frame 2 and a vertical outer frame 22 is provided a paper discharge conveyor 26 made up of roller 23 and 24 at opposite ends and a plurality of endless belts 25 passing about the rollers 23 and 24. A tension roller 27 is provided for switching transfer paths by selectively bending the upper or lower run of the belt 25.

At an intermediate point of the path of transferring the sections defined by endless conveyors 16 and 17 extending between the gripping roller 10 and the impeller 15 is provided a chopper 28 including a vertically movable chopper blade for folding into half size the sections being conveyed in the transverse direction and a pair of impellers 29 is disposed beneath the chopper 28 for discharging half size (or doubly folded) sections toward lower. First and second conveyors 30 and 31 are provided beneath the impeller 29. A guide roller 32 of the first conveyor 30 is swingably supported by a bracket 33 secured to the frame 2, and one end of the roller 32 rotatably supports a belt supporting plate 34 which is normally held at a horizontal fixed state by a rotating device, not shown. A roller 35 is rotatably mounted on one end of the belt supporting plate 35 and a tension roller 37 is adjustably mounted on the lower end of a bracket 36 depending from the belt supporting plate 34. A plurality of parallel paper discharge belts 38 are provided to pass about rollers 32, 35 and 37, the vertical sectional configuration of these belts 38 being triangular as shown in FIG. 1. A roller 39 of the second conveyor is rotatably mounted on the bracket 33 at a position behind the roller 32, and a belt supporting plate 40 rotatably mounted on the other end of roller 39, the edge of the plate 40 extending toward lower at the inclined run of the belt 38. The belt supporting plate 40 is normally held at a solid line position shown in FIG. 2 by a rotating device, not shown. A roller 41 is rotatably mounted on the lower end of the belt supporting plate 40 adjacent the roller 19 of the conveyor 21. A plurality of parallel belts 42 are passed about the rollers 39 and 41. The belts 42 are applied with a tension by means of a tension roller 43.

A switching plate 44 in the form of a square plate is rotatably mounted on one end of the roller 32 adjacent the bracket 33, and the plate 44 is adjusted by a locking handle 47 threaded into a threaded opening of the plate 44. Also to this switching plate 44 is secured a switching handle 48 for rotating the same. A pair of meshing switching gears 49 and 50 are rotatably mounted on the switching plate 44 substantially in a vertically aligned relation. One switching gear 50 meshes with a gear 51 mounted on the roller 32. A roller 39 connected to the roller 23 through a chain 52 is provided with a gear 53 which is caused to selectively mesh with either one of the switching gears when the switching plate 44 is rotated. Consequently meshing of gears 39 and switching gear 49 transmits the rotation of the roller 39 to roller 32 through gears 53, 49, 50 and 51, thus rotating roller 32 in the opposite direction with respect to roller 39. On the other hand meshing gears 39 and the switching gear 50 transmits the rotation of the roller 39 to roller 32 via gears 53, 50 and 51, thus rotating the roller 32 in the same direction as roller 39. When rollers 32 and 39 are rotated in the opposite direction, the inclined run of belt 38 and the upper run of belt 42 run in the same direction as shown by arrow L, thus forming a transfer path for the sections. When the rollers 32 and 39 are rotated in the same direction, the belt 38 runs in the direction of arrow M to form a transfer path for the sections at the upper horizontal portion of belt 38. Stop means 54 and 55 are provided for limiting angular rotation of the switching plate 44. A chain 56 interconnects rollers 39 and 19 and applied with a tension by a tension sprockets 57. A conveyor 58 is provided for feeding sections to a stacker.

The folding device 1 described above operated as follows. Thus the paper web 4 fed into the folding device 1 is directed into either one of four section paths depending upon the type of the sections. Where a path through the folding roller 7 overlapping roller 8 and the needle roller 9 or a path through the folding roller 7 the gripping roller 10 and the discharge roller 11 is selected, the sections formed by these paths are discharged onto conveyor 21 through impeller 12 or 14. The sections formed by a path including the folding roller 7 and the gripping roller 10 are discharged upwardly and those not acted upon by the chopper 28 are conveyed by belts 16 and 17 and then discharged onto the conveyor 26. Where the same path and the chopper 28 are used the resulting sections are discharged onto the conveyor 30 by the impellers 29.

Figure 3:
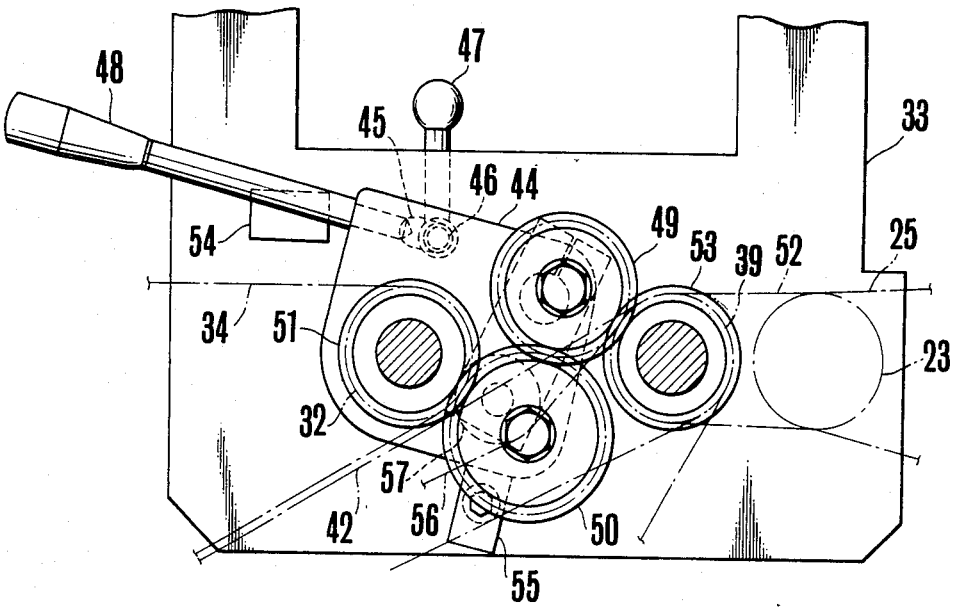
FIG. 3 is a side view showing a running direction change gear mechanism.
Figure 4:
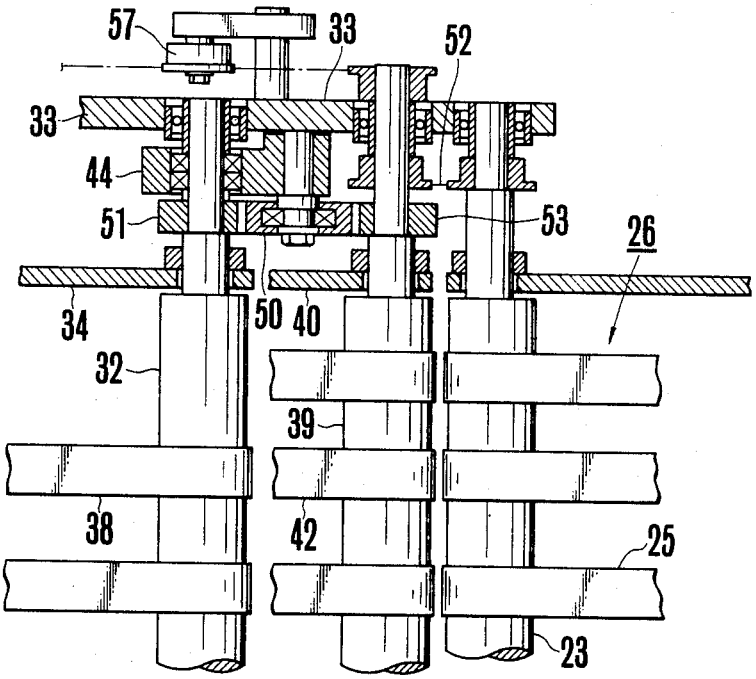
FIG. 4 is a sectional view of the gear mechanism.

Two types of sections loaded on the conveyor 21 are transferred to conveyor 31. More particularly as shown in FIG. 3, when gear 53 is meshed with switching gear 49, as the conveyors 30 and 31 and the belts 38 and 42 run in the same direction L as shown in FIG. 1, the sections received from the conveyor 21 are clamped between upper and lower belts 38 and 42 to be transferred along upwardly inclined path and then discharged onto the conveyor 26.

The direction of running of the belt is changed for the sections discharged onto the conveyor 30. To this end, the locking handle 47 is loosened, and the switching plate 44 is rotated with the switching handle to disengage switching gear 49 from gear 53 and cause the switching gear 49 to engage gear 39 for fixing the switching plate 44. Then the belt 38 runs in the opposite direction M, so that the sections are transferred along the upper horizontal portion of the belt 38 and then delivered to the conveyor 26. When the sections are to be discharged by impeller 15, the tension roller 27 engaging the conveyor 26 is rotated to bring the belt 25 to a dot and line position shown in FIG. 1.

As above described four types of sections are all discharged or delivered onto the conveyor 26 and then transferred onto conveyor 58 leading to the stacker to be stacked.

Figure 2:
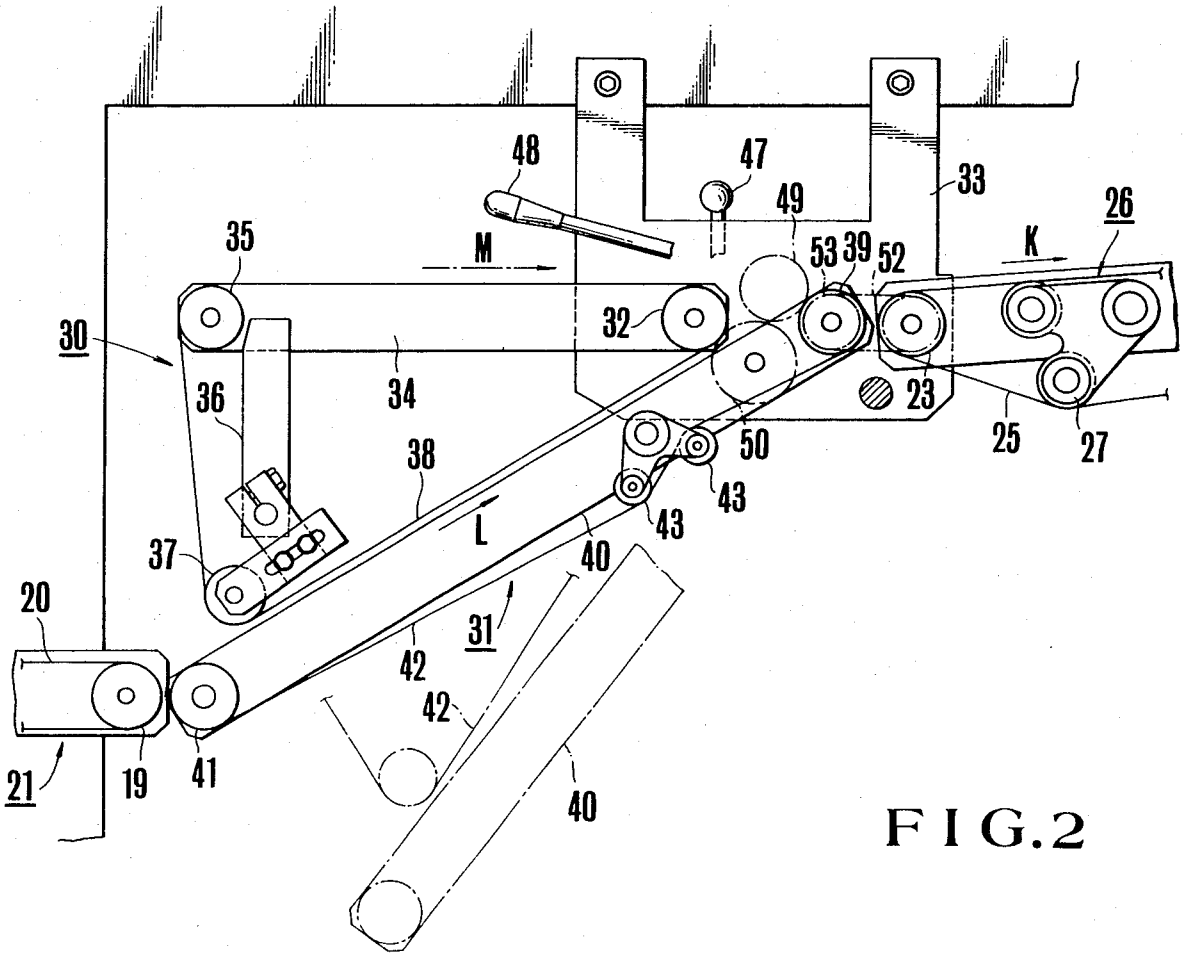
FIG. 2 is a side view showing a paper discharge apparatus.

When paper is clogged between belts 38 and 42, the belt supporting plates 34 and 40 are rotated toward the floor as shown by dot and dash lines shown in FIG. 2. Since both plates 34 and 40 have different centers of rotation, belts 38 and 42 are separated away to come into alignment with a window, not shown, of the frame, the clogged paper can be removed readily.

As above described, according to this invention, in a folding device for use in a rotary press, there are provided a first conveyor having a horizontal run and an inclined run and a triangular sectional configuration, and a second conveyor with its upper run extended along the inclined run, and the direction of running of the first conveyor is reversed by a gear mechanism so that the sections are conveyed to the same place by selectively using either one of the horizontal run and the inclined run. Accordingly, it is possible to convey all sections of a number of types folded by the same folding device in the same direction and to the same place, thus greatly increasing the efficiency of discharging and stacking the sections. This also eliminates the provision of a stacker so that the cost of installation and floor space can be reduced.

What is claimed is:

1. A paper discharge apparatus for use in a paper folder of a rotary press comprising a system of conveyors wherein there is a discharge conveyor and first and second conveyors so arranged that said first conveyor is operable to deliver sections from one source to the discharge conveyor and in combination with said second conveyor is operable to deliver sections from another source to said discharge conveyor, said discharge conveyor defining a generally horizontal run onto the receiving end of which the first and second conveyors are adapted to deliver sections from said alternate sources and from the other end of which the sections from the two sources are discharged and wherein the first conveyor has a horizontal run onto which the sections from the one source are deposited and an end adjacent the receiving end of the discharge conveyor, and wherein the second conveyor has an inclined run, the lower end of which is situated at a level to receive sections from the second source and an upper end situated at the level of the receiving end of the discharge conveyor between the receiving end of the discharge conveyor and the delivery end of the horizontal run of the first conveyor and wherein the first conveyor has an inclined run parallel to the inclined run of the second conveyor cooperable with the inclined run of the second conveyor to move a section delivered to the lower end of the second conveyor to the upper end thereof and from thence onto the receiving end of the delivery conveyor, means for driving the respective conveyors comprising means for driving the first conveyor in a direction such that the upper horizontal run moves in a direction toward the receiving end of the discharge conveyor when delivering sections deposited thereon to the discharge conveyor, means for driving the second conveyor in a direction such that the inclined run moves upwardly toward the receiving end of the discharge conveyor when moving sections delivered to the lower end thereof to the receiving end of the discharge conveyor and wherein there are change gears for reversing the direction of movement of the first conveyor without changing the direction of movement of the second conveyor to cause the inclined run of the first conveyor to travel in the same direction as the inclined run of the second conveyor to in combination therewith move sections delivered to the lower end of the second conveyor to the upper end thereof onto the receiving end of the discharge conveyor.

2. The apparatus according to claim 1 which further comprises a chopper which folds sections into sections of a half size, and means for transferring said half size sections onto the upper horizontal run of said first conveyor.

3. A paper discharge apparatus according to claim 1 wherein rolls support the respective conveyors comprising means driving the support roll at the receiving end of the discharge conveyor, a drive gear fixed to the roll at the receiving end of the discharge conveyor, a drive gear fixed to each of the rolls at the discharge ends of the first and second conveyors and a change gear operable continuously to transmit rotation of the drive gear fixed to the shaft at the receiving end of the discharge conveyor to the gear fixed to the roll at the discharge end of the second conveyor in one direction, and alternately effect rotation of the drive gear fixed to the roll at the discharge end of the first conveyor in clockwise and counterclockwise directions.

4. Apparatus according to claim 1 comprising an impeller positioned above the receiving end of the discharge conveyor adjacent the discharge ends of the first and second conveyors, for delivering a third type of section to the discharge conveyor, and a tension roller engaged with the discharge conveyor operable to alternately position the discharge conveyor in a position to receive sections for the first and second conveyors on the one hand and from the impeller on the other hand.

5. Apparatus according to claim 4 wherein the discharge conveyor discharges sections from said first and second conveyors on the one hand and from the impeller on the other hand to a stacker.

* * * * *